US008115400B2

(12) United States Patent
Li et al.

(10) Patent No.: US 8,115,400 B2
(45) Date of Patent: Feb. 14, 2012

(54) BACKLIGHT MODULE

(75) Inventors: Szu-Han Li, Hsinchu (TW); Yuan-Pin Cho, Hsinchu (TW); Kuang-Chou Lai, Hsinchu (TW); Chia-Hung Sun, Hsinchu (TW)

(73) Assignee: Au Optronics Corp., Hsinchu (TW)

( * ) Notice: Subject to any disclaimer, the term of this patent is extended or adjusted under 35 U.S.C. 154(b) by 639 days.

(21) Appl. No.: 12/053,054

(22) Filed: Mar. 21, 2008

(65) Prior Publication Data

US 2009/0189531 A1 Jul. 30, 2009

(30) Foreign Application Priority Data

Jan. 30, 2008 (TW) ..... 97103451 A

(51) Int. Cl.
*H05B 37/00* (2006.01)
*G09G 3/36* (2006.01)

(52) U.S. Cl. ..... 315/161; 315/294; 315/312; 345/102

(58) Field of Classification Search ..... 315/160, 315/161, 167, 169.4, 178, 184, 291, 312, 315/294, 297; 345/102; 362/97.2, 257, 262, 362/614

See application file for complete search history.

(56) References Cited

U.S. PATENT DOCUMENTS 6,930,442 B2 8/2005 Awamoto et al.
6,962,429 B2 * 11/2005 Yamamoto ..... 362/614
7,362,059 B2 * 4/2008 Park ..... 315/291
2003/0022601 A1 1/2003 Shimomura
2006/0061305 A1 * 3/2006 Ahn et al. ..... 315/312
2006/0108953 A1 * 5/2006 Adam et al. ..... 315/390
2006/0284565 A1 * 12/2006 Iida et al. ..... 315/209 R
2006/0290453 A1 * 12/2006 Park et al. ..... 336/69
2007/0046217 A1 * 3/2007 Liu ..... 315/291
2007/0108917 A1 * 5/2007 Sengoku et al. ..... 315/282
2007/0171677 A1 * 7/2007 Yano et al. ..... 362/614
2008/0007957 A1 * 1/2008 Satoh et al. ..... 362/362
2008/0024422 A1 * 1/2008 Kim et al. ..... 345/102
2008/0061708 A1 * 3/2008 Wi et al. ..... 315/277
2010/0019685 A1 * 1/2010 Kominami et al. ..... 315/250

* cited by examiner

*Primary Examiner* — Tung X Le
(74) *Attorney, Agent, or Firm* — Thomas, Kayden, Horstemeyer & Risley, LLP

(57) ABSTRACT

Backlight module is disclosed. The backlight module includes a first lamp, a first voltage source, a second lamp, a second voltage source, a first external electrode, and a second external electrode. Both the first and the second voltage sources have a first terminal and a second terminal. The first voltage source is used to output a first voltage signal and electrically couples to the first terminal of the first lamp. The second voltage source is used to output a second voltage signal and electrically couples to the first terminal of the second lamp. Both the first external electrode and the second external electrode have a first terminal and a second terminal. The first terminal of the first external electrode electrically couples to the second voltage source and the first terminal of the second external electrode electrically couples to the first voltage source, wherein the first voltage signal and the second voltage signal are inverted.

11 Claims, 4 Drawing Sheets

BACKLIGHT MODULE

This application claims the benefit of priority based on Taiwan Patent Application No. 097103451 filed on Jan. 30, 2008, the disclosures of which are incorporated herein by reference in their entirety.

BACKGROUND OF THE INVENTION

1. Field of the Invention

The present invention relates to a backlight module, and more particularly, to an external electrode fluorescent lamp for use in a backlight module.

2. Descriptions of the Related Art

Because of making great progress in the manufacturing technology of the liquid crystal display (LCD), LCDs have many advantages such as light, thin, power-saving and radiation-less properties. Based on the above advantages, LCDs are widely used in various electrical products, for example, personal digital assistants (PDAs), notebook computers, digital cameras, digital camcorders, mobile telephones, computer monitors, and liquid crystal televisions. However, because the LCD panel cannot illuminate by itself, a backlight module is required to provide a light source for the LCD panel. The conventional backlight module has several cold cathode fluorescent lamps (CCFLs) as the light source to lighten the LCD panel.

A CCFL usually generates heat and hence leads to the nearby area at high temperature while emitting light. More particularly, as the required brightness of the LCD is gradually increasing, the increased brightness of the CCFL inevitably generates more heat, and the internal environmental temperature of the LCD is thus increased. Besides increase in heat, the driving voltage of the CCFLs also becomes higher. Consequently, the nearby environmental temperature of the CCFL would increase a lot, and thereby deteriorate the light emitting quality of the CCFL and the operating quality of the backlight module.

External electrode fluorescent lamps (EEFLs) are proposed to solve the problems mentioned above. FIG. 1 is a schematic diagram illustrating the cross-sectional view of a prior art EEFL. The prior art EEFL requires two driving circuits. For example, in the embodiment of FIG. 1, one driving circuit includes a pair of inner electrodes 11 and 12 stretching into the glass tube 15, and the other includes an outer electrode 13 surrounding the glass tube 15. The inner surface of the glass tube 15 is coated with fluorescent material and the inner space of the glass tube 15 is filled with gas 16. The gas 16 can be the mixture of some noble gases and Hg gas. When voltages are applied to the inner electrodes, the electrons are emitted from electrodes and bombard the Hg gas. Then, the excited Hg gas generates ultra-violet (UV) light when the Hg atoms transit from an excited state to a ground state. After the UV light then strikes the phosphor coated in the inner surface of the glass tube, visible light is hence emitted. Though EEFLs are proposed to solve the problems mentioned above, the working voltages of EEFLs are too high to result in a current leakage and the luminance of the lamp is reduced because the outer electrode 13 surrounding the lamp tube 15. Accordingly, further improvements in the back light module are still required for the industry.

SUMMARY OF THE INVENTION

One objective of the present invention is to provide a backlight module with a new design for external electrode fluorescent lamps to reduce the start voltage and the current leakage thereof.

According to the above-mentioned objective, the backlight module includes a first lamp, a first voltage source, a second lamp, a second voltage source, a first external electrode, and a second external electrode. Both the first and the second voltage sources have a first terminal and a second terminal. The first voltage source is used to output a first voltage signal and electrically couples to the first terminal of the first lamp. The second voltage source is used to output a second voltage signal and electrically couples to the first terminal of the second lamp. Both the first external electrode and the second external electrode have a first terminal and a second terminal. The first terminal of the first external electrode electrically couples to the second voltage source and the first terminal of the second external electrode electrically couples to the first voltage source, wherein the first voltage signal and the second voltage signal are inverted.

The detailed technology and preferred embodiments implemented for the subject invention are described in the following paragraphs accompanying the appended drawings for people skilled in this field to well appreciate the features of the claimed invention.

BRIEF DESCRIPTION OF THE DRAWINGS

Embodiments of the invention will be described with reference to the accompanying drawings in which:

FIG. 6(*c*) is a schematic diagram illustrating the component configuration of the backlight module according to one preferred embodiment of the present invention;

DESCRIPTION OF THE PREFERRED EMBODIMENT

Figure 2:
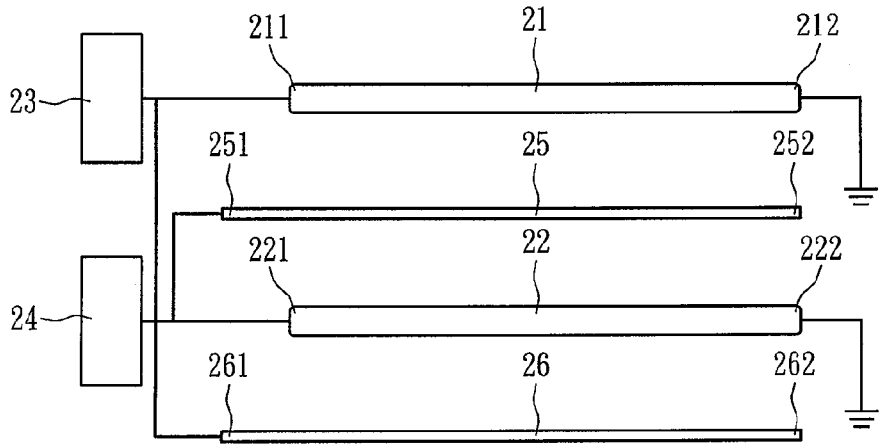
FIG. 2 is a schematic diagram illustrating one preferred embodiment of the backlight module according to the present invention.

Refer to FIG. 2, which is a schematic diagram illustrating one preferred embodiment of the backlight module according to the present invention. The backlight module comprises a first lamp 21, a second lamp 22, a first voltage source 23, a second voltage source 24, a first external electrode 25, and a second external electrode 26. The first lamp 21 has a first terminal 211 and a second terminal 212. The first voltage source 23 electrically couples to the first terminal 211 of the first lamp 21 for outputting a first voltage signal. The second lamp 22 has a first terminal 221 and a second terminal 222. The second voltage source 24 electrically couples to the first terminal 221 of the second lamp 22 for outputting a second voltage signal. The first external electrode 25 has a first terminal 251 and a second terminal 252, wherein the first terminal 251 of the first external electrode 25 electrically couples to the second voltage source 24. The second external electrode 26 has a first terminal 261 and a second terminal 262, wherein the first terminal 261 of the second external electrode 26 electrically couples to the first voltage source 23.

Moreover, the second terminals 212, 222 of the first and the second lamps 21, 22 are grounded, and the second terminals 252, 262 of the first and the second external electrodes 25, 26 are floating. It is noted that the phase of the first voltage signal and the second voltage signal are preferably inverted. Since the first voltage signal and the second voltage signal are mutually inverted, the voltage difference between the first lamp 21 and the first external electrode 25 becomes larger. That is, the voltage difference between the first lamp 21 and the first external electrode 25 is the sum of the individual absolute amplitude of the first voltage signal and the second voltage signal. According to the configuration of the embodiment of the present invention, the voltages applied to the lamps can be lower than the conventional start voltages and hence reduce power consumption of the backlight module.

Figure 3:
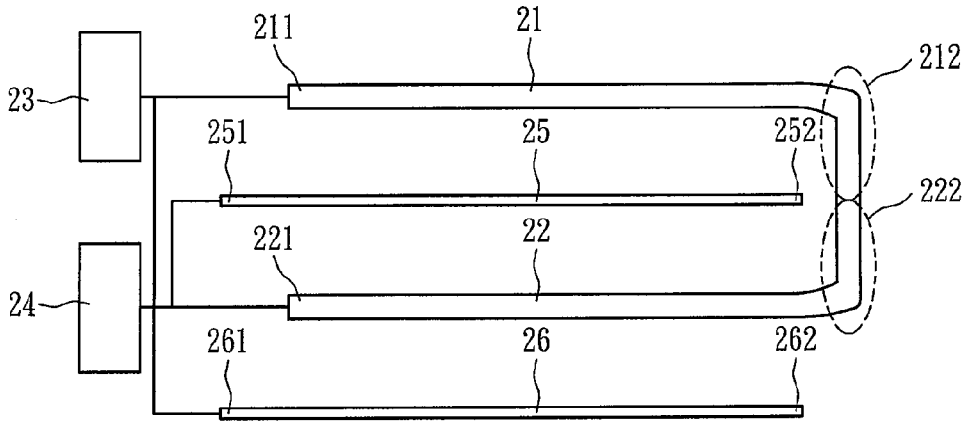
FIG. 3 is a schematic diagram illustrating one preferred embodiment of the backlight module according to the present invention.

Please continue to refer to FIG. 3, which is a schematic diagram of another preferred embodiment of the backlight module according to the present invention. The backlight module of this embodiment, in FIG. 3, also comprises a first lamp 21, a second lamp 22, a first voltage source 23, a second voltage source 24, a first external electrode 25, and a second external electrode 26. The configuration of the abovementioned components in this embodiment is similar with that of the embodiment as shown in FIG. 2. It is noted that the second terminal 212 of the first lamp 21 connects to the second terminal 222 of the second lamp 22. More specifically, the first and the second lamp 21, 22 together form a U shape. Compared with the conventional lamp, the U shape lamp provides more luminance because it has an extra portion formed by connecting the the second terminal 212 of the first lamp 21 and the second terminal 222 of the second lamp 22. Similarly, the phase of the first voltage signal and the second voltage signal are preferably inverted for reducing the start voltage of the lamp and the power consumption as well.

Figure 4:
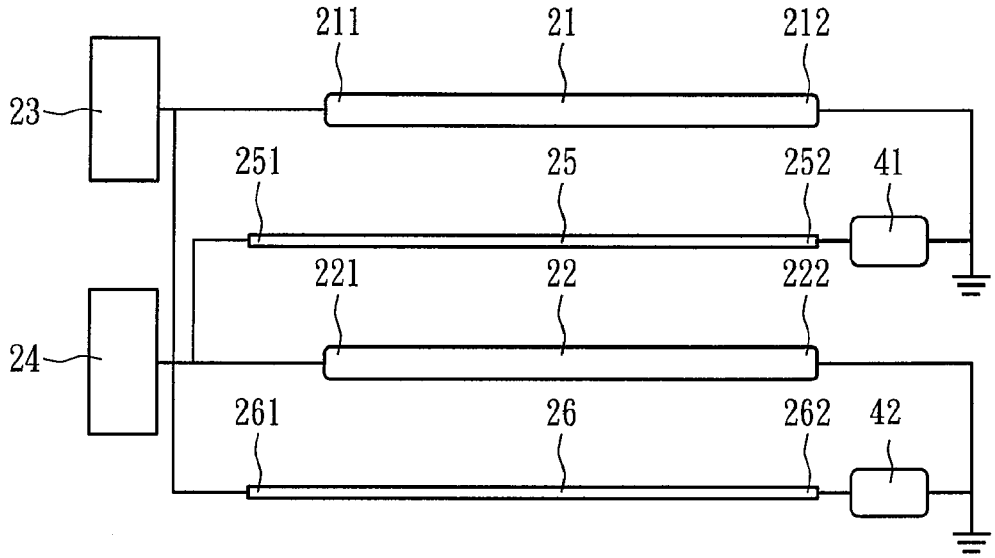
FIG. 4 is a schematic diagram illustrating one preferred embodiment of the backlight module according to the present invention.

Referring to FIG. 4, a schematic diagram illustrating one preferred embodiment of the backlight module according to the present invention is disclosed. The backlight module shown in FIG. 4 has the similar components and configuration with the abovementioned embodiments. Compared with the abovementioned embodiments, the main difference of this embodiment is that two high-impedance circuits 41, 42 electrically couple to the second terminal 252 of the first external electrode 25 and the second terminal 262 of the second external electrode 26, respectively. The high-impedance circuits 41, 42 optionally comprise passive components such as resistors, capacitors, inductors, or the combinations thereof. Owing to the high resistance of the high-impedance circuits 41, 42, the second terminals 252, 262 of the first and the second external electrodes 25, 26 have an effect similarly to be floating. The phase of the first voltage signal and the second voltage signal are inverted. According to the configuration of the embodiment of the present invention, the voltages applied to the lamps can be lower than the conventional start voltages and hence the power consumption of the backlight module can be reduced.

Figure 5:
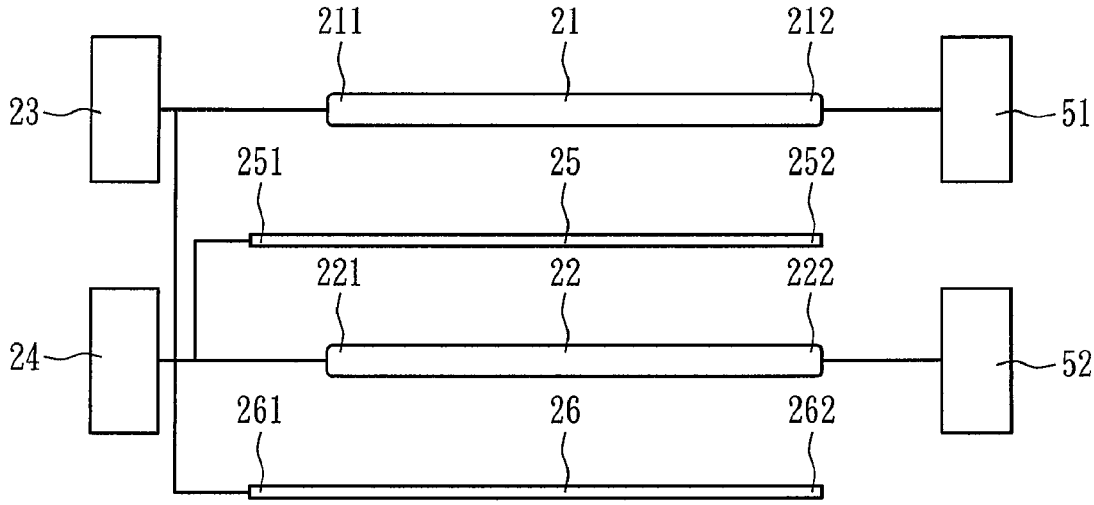
FIG. 5 is a schematic diagram illustrating one preferred embodiment of the backlight module according to the present invention.

Referring to FIG. 5, a schematic diagram illustrating one preferred embodiment of the backlight module according to the present invention is disclosed. The backlight module of this embodiment is also similar to that of the abovementioned embodiments. More specifically, the backlight module of this embodiment further comprises a third voltage source 51 and a fourth voltage source 52. Furthermore, the third voltage source 51 electrically couples to the second terminal 212 of the first lamp 21 for outputting a third voltage signal and the fourth voltage source 52 electrically couples to the second terminal 222 of the second lamp 22 for outputting a fourth voltage signal. Preferably, there is a phase difference, such as, but not limited to, 180 degrees, between the first voltage signal and second voltage signal and between the first voltage signal and the third voltage, while there is no phase difference between the first voltage signal and fourth voltage signal. By adding the third voltage source 51, the voltage difference between the first terminal 211 and the second terminal 212 becomes larger. That is, the voltage difference between the first terminal 211 and the second terminal 212 is the sum of the individual absolute amplitude of the first voltage signal and the second voltage signal. According to the configuration of the embodiment of the present invention, the voltages applied to the lamps can be lower than the conventional start voltages and hence reduce power consumption of the backlight module.

Figure 6A:
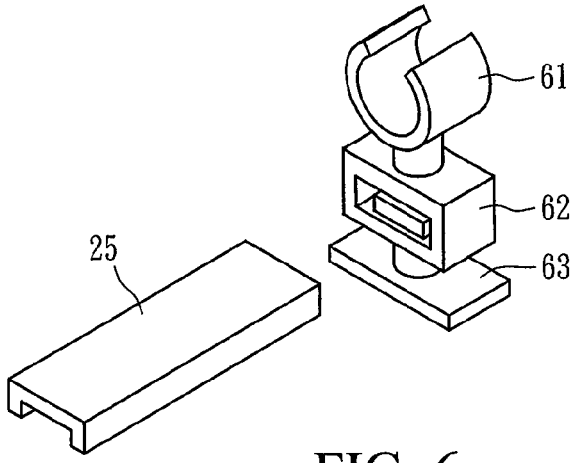
FIG. 6(*a*) and FIG. 6(*b*) are schematic diagrams illustrating the component configuration of the backlight module according to one preferred embodiment of the present invention.
Figure 6B:
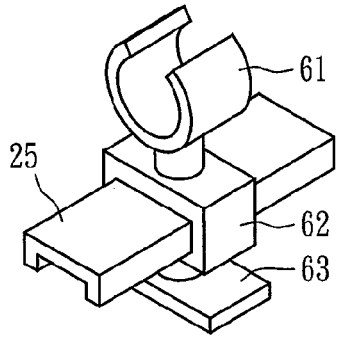
Figure 6C:
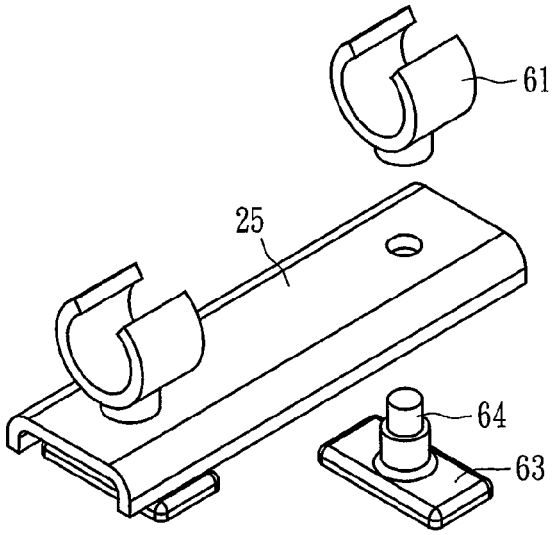

Please refer to FIG. 6(*a*) and FIG. 6(*b*), which are schematic diagrams illustrating the component configuration of the backlight module according to one preferred embodiment of the present invention. In this embodiment, the backlight module further comprises a lamp holder 61, an electrode holder 62, and a base support 63. Specifically, the lamp holder 61 is used to fix the first lamp (not shown) or the second lamp (not shown), and the electrode holder 62 is disposed between the lamp holder 61 and the base support 63. Refer to FIG. 6(*c*), which is a schematic diagram illustrating the component configuration of the backlight module according to another preferred embodiment of the present invention. In this embodiment, the lamp holder 61has an extending portion 64, and the lamp holder 61 and the base support 63 are assembled by inserting the extending portion 64 into the lamp holder 61 through an opening of the first external electrode 25.

Figure 7:
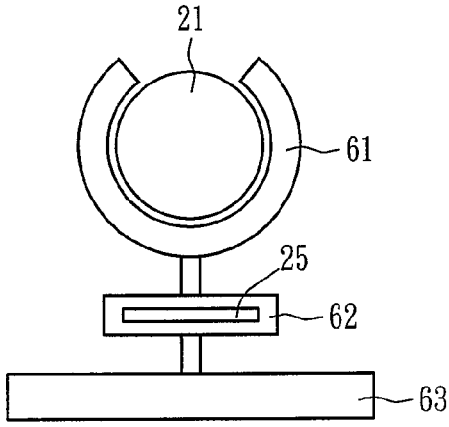
FIG. 7 is a schematic diagram illustrating the component configuration of the backlight module according one preferred embodiment of the present invention.

Moreover, in the abovementioned embodiments, the first external electrode 25 and the second external electrode (not shown) both have elongated structures and the electrode holder 62 has an annular structure so that the electrode holder 62 is able to accommodate the first external electrode 25 or the second external electrode (not shown) therein. Further moreover, please refer to FIG. 7, in the preferred embodiment, the diameter of the first lamp 21 is greater than the width of the first external electrode 25 and the diameter of the second lamp (not shown) is greater than the width of the second external electrode so that the external electrode can be totally covered by the lamp from the top view.

Figure 1:
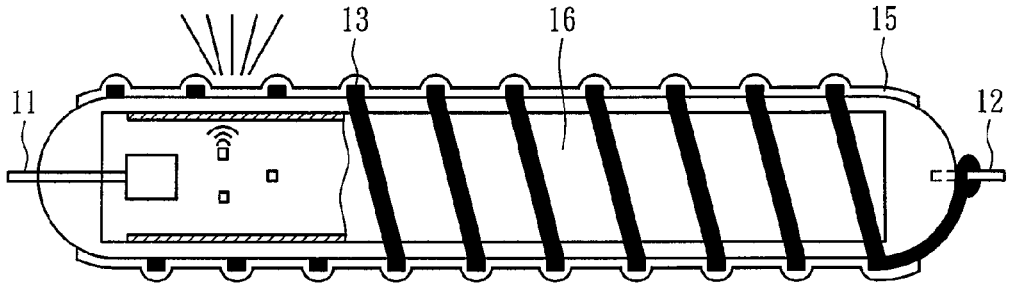
FIG. 1 (Prior Art)
FIG. 1 is a schematic diagram illustrating the cross-sectional view of a prior art EEFL.

It is noted that, in the abovementioned embodiments, the lamp fixed by the lamp holder is disposed above the external electrode so that lights emitted from the lamp won't be partially covered by the external electrode and the luminance of the lamp can be effectively increased. In a preferred embodiment, some reflective thin films can be coated on the outer surface of the external electrode to further increase the luminance of the lamp. The disadvantage of the prior art shown in FIG. 1 that the luminance of the lamp is reduced can be improved.

Figure 8:
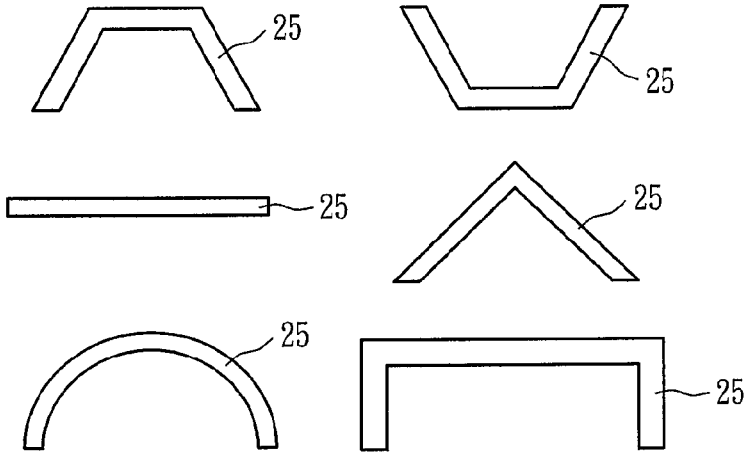
FIG. 8 is a schematic diagram illustrating various shapes of the external electrodes according one preferred embodiment of the present invention.
Figure 9:
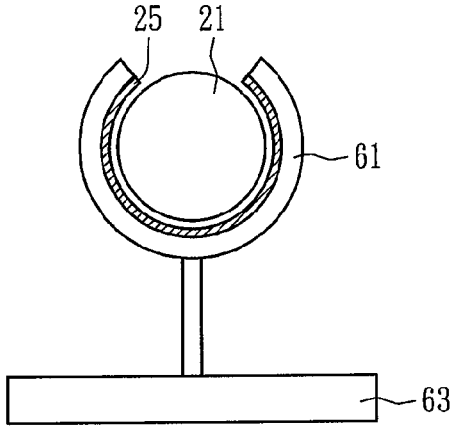
FIG. 9 is a cross-sectional view of one preferred embodiment of the backlight module according to the present invention.

The cross-sectional view of the external electrode can have many shapes as shown in FIG. 8, and the shape of the external electrode can be arbitrary chosen according to the real requirement. Refer to FIG. 9, which is a cross-sectional view of one preferred embodiment of the backlight module according to the present invention. The lamp holder 61 is used to fix the first lamp 21, while the first external electrode 25 is disposed on the inner surface of the lamp holder 61. More specifically, the first external electrode 25 can be a metal layer coated on the inner surface of the lamp holder 61. Besides, in order to obtain better heat dissipation characteristics, the external electrode is preferably separated from the lamp for a predetermined interval.

The invention has been described in the context of several exemplary embodiments. However, it is to be understood that the scope of the invention is not limited to only the disclosed embodiments. On the contrary, the scope of the invention is intended to include various modifications and alternative arrangements within the capabilities of persons skilled in the art using presently known or future technologies and equivalents. The scope of the claims, therefore, should be accorded the broadest interpretation so as to encompass all such modifications and similar arrangements.

What is claimed is:

1. A backlight module, comprising:

a first lamp having a first terminal and a second terminal;

a first voltage source for outputting a first voltage signal electrically coupled to the first terminal of the first lamp;

a second lamp having a first terminal and a second terminal;

a second voltage source for outputting a second voltage signal electrically coupled to the first terminal of the second lamp;

a third voltage source electrically coupled to the second terminal of the first lamp;

a fourth voltage source electrically coupled to the second terminal of the second lamp;

a first external electrode having a first terminal and a second terminal, and the first terminal of the first external electrode electrically coupled to the second voltage source; and a second external electrode having a first terminal and a second terminal, and the first terminal of the second external electrode electrically coupled to the first voltage source, wherein the first voltage signal and the second voltage signal are inverted.

2. The backlight module of claim 1, wherein the second terminal of the first external electrode is floating.

3. The backlight module of claim 1, wherein the third voltage source can output a third voltage signal to the first lamp and the fourth voltage source can output a fourth voltage signal to the second lamp.

4. The backlight module of claim 1, wherein the first external electrode and the second electrode both have elongated structures.

5. The backlight module of claim 4, wherein the diameter of the first lamp is greater than the width of the first external electrode and the diameter of the second lamp is greater than the width of the second external electrode.

6. The backlight module of claim 5, further comprising:

a lamp holder for fixing the first lamp;

a base support; and an electrode holder, disposed between the lamp holder and the base support, adapted to receive the first external electrode.

7. The backlight module of claim 6, wherein the electrode holder has an annular structure for receiving the first external electrode.

8. The backlight module of claim 5, wherein the first external electrode has an opening configured in the elongated structure.

9. The backlight module of claim 8, further comprising:

a lamp holder for fixing the first lamp; and a base support having a extending portion, wherein the lamp holder and the base support are assembled by inserting the extending portion into the lamp holder through the opening of the first external electrode.

10. The backlight module of claim 1, further comprising a lamp holder for fixing the first lamp, wherein the first external electrode is disposed on an inner surface of the lamp holder.

11. The backlight module of claim 10, wherein the first external electrode includes a metal layer coated on the inner surface of the lamp holder.

* * * * *